US010679555B2

(12) United States Patent
Wang et al.

(10) Patent No.: US 10,679,555 B2
(45) Date of Patent: Jun. 9, 2020

(54) PIXEL CIRCUIT AND METHOD FOR DRIVING THE SAME, AND DISPLAY APPARATUS

(71) Applicant: BOE TECHNOLOGY GROUP CO., LTD., Beijing (CN)

(72) Inventors: Longyan Wang, Beijing (CN); Yongqian Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 191 days.

(21) Appl. No.: 15/757,786

(22) PCT Filed: Aug. 14, 2015

(86) PCT No.: PCT/CN2015/087056

§ 371 (c)(1),
(2) Date: Mar. 6, 2018

(87) PCT Pub. No.: WO2016/161737

PCT Pub. Date: Oct. 13, 2016

(65) Prior Publication Data

US 2018/0233082 A1 Aug. 16, 2018

(30) Foreign Application Priority Data

Apr. 9, 2015 (CN) ..... 2015 1 0166569

(51) Int. Cl.
*G09G 3/30* (2006.01)
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0426* (2013.01);
(Continued)

(58) Field of Classification Search
CPC ... G09G 3/30; G09G 3/36; G09G 5/00; G06F 3/038
See application file for complete search history.

(56) References Cited

U.S. PATENT DOCUMENTS

2006/0061526 A1* 3/2006 Shirasaki ..... G09G 3/3233 345/77
2008/0231560 A1* 9/2008 Yamashita ..... G09G 3/3233 345/76

(Continued)

FOREIGN PATENT DOCUMENTS

CN 102074186 A 5/2011
CN 102890910 A 1/2013

(Continued)

OTHER PUBLICATIONS

International Search Report dated Aug. 14, 2015, issued in counterpart International Application No. PCT/CN2015/087056 (13 pages).

(Continued)

*Primary Examiner* — Pegeman Karimi
(74) *Attorney, Agent, or Firm* — Westerman, Hattori, Daniels & Adrian, LLP

(57) ABSTRACT

The present disclosure provides a compensating circuit. The compensating circuit includes a feedback module, and a driving transistor with a first gate, a second gate, a first electrode, and a second electrode. A first terminal of the feedback module is connected to a first voltage source and a second terminal of the feedback module is connected to the first electrode and the second gate of the driving transistor; and the first gate of the driving transistor is connected to a data line, and the second electrode of the driving transistor for outputting a driving current.

20 Claims, 7 Drawing Sheets

(52) U.S. Cl.
CPC ..... *G09G 2300/0819* (2013.01); *G09G 2300/0838* (2013.01); *G09G 2300/0842* (2013.01); *G09G 2300/0885* (2013.01); *G09G 2320/043* (2013.01)

(56) References Cited

U.S. PATENT DOCUMENTS

| | | | | |
|---|---|---|---|---|
| 2010/0033476 | A1 | 2/2010 | Yamamoto et al. | |
| 2011/0122325 | A1 | 5/2011 | Yamashita et al. | |
| 2013/0257698 | A1* | 10/2013 | Toya | H01L 27/124 345/77 |
| 2014/0091996 | A1 | 4/2014 | Moon et al. | |
| 2014/0346968 | A1 | 11/2014 | Meng et al. | |
| 2016/0042694 | A1* | 2/2016 | Lim | G09G 3/3233 345/78 |
| 2018/0047333 | A1* | 2/2018 | Nie | G09G 3/3208 |

FOREIGN PATENT DOCUMENTS

| | | | |
|---|---|---|---|
| CN | 103117042 | A | 5/2013 |
| CN | 103714784 | A | 4/2014 |
| CN | 104732927 | A | 6/2015 |
| JP | 9-321547 | A | 12/1997 |
| KR | 20140080728 | A | 7/2014 |
| KR | 20140080729 | A | 7/2014 |

OTHER PUBLICATIONS

Office Action dated Sep. 5, 2016, issued in counterpart Chinese Application No. 201510166569.X (8 pages).

Office Action dated Mar. 20, 2017, issued in counterpart Chinese Application No. 201510166569.X (8 pages).

Chou, Lu-Sheng at al., "Dual-Gate IGZO TFT for Threshold-Voltage Compensation in AMOLED Pixel Circuit", SID, 2012, 4 pages.

Tai, Ya-Hsiang et al., "Three-Transistor AMOLED Pixel Circuit With Threshold Voltage Compensation Function Using Dual-Gate IGZO TFT", IEEE Electron Device Letters, Mar. 2012, vol. 33, No. 3, pp. 393-395.

Jankovic, N.D. et al., "Vth compensated AMOLED pixel employing dual-gate TFT driver", Electronics Letters, Mar. 31, 2011, vol. 47, No. 7, 2 pages.

* cited by examiner

PIXEL CIRCUIT AND METHOD FOR DRIVING THE SAME, AND DISPLAY APPARATUS

CROSS-REFERENCES TO RELATED APPLICATIONS

This PCT patent application claims priority of Chinese Patent Application No. 201510166569.X, filed on Apr. 9, 2015, the entire content of which is incorporated by reference herein.

FIELD OF THE INVENTION

The present invention generally relates to the display technologies and, more particularly, relates to pixel circuits and method for driving the same, and a display apparatus containing the same.

BACKGROUND

The Active Matrix Organic Light-Emitting Diode (AMOLED) display panels have advantages such as short response times, high display brightness levels, high display contrasts, and low power consumption levels. It is also easier to produce transparent and flexible AMOLED display panels. The AMOLED display technology is often regarded as a main stream display technology. Nowadays, development efforts have promoted the mass production of AMOLED display panels.

Pixel array formed by active matrix or Thin Film Transistors (TFTs) is a key component of the AMOLED display technology. In existing AMOLED display technologies, amorphous-silicon TFTs, low-temperature poly-silicon TFTs, organic semiconductor TFTs, and certain metal oxide TFTs are often used to drive the pixels that form the pixel array. However, problems or defects related to TFT threshold voltage shifts and threshold voltage non-uniformity may exist in the existing AMOLED display technologies. As a result, when driving organic light-emitting diode (OLED) pixels, an existing TFT array may not be able to provide stable and/or uniform driving currents. The display quality of the corresponding AMOLED display panel may therefore be adversely affected.

To solve the problems mentioned in the existing AMOLED display technologies, pixel circuits for compensating the threshold voltage shifts and threshold voltage non-uniformity have been developed. Until now, many of the developed pixel circuits have an undesirably large number of TFTs and/or control signal lines, which may occupy an undesirably large area on the circuit board and limit the aperture ratio of the display panel. Improvements on the display resolution may be limited. On the other hand, the pixel driving circuits with fewer TFTs (e.g., 2 or 3 TFTs) often require relatively complex control in timing, making it difficult to implement peripheral driving in the display panel.

BRIEF SUMMARY OF THE DISCLOSURE

The present invention addresses the above problems in the prior art. The present disclosure provides a compensating circuit and related display apparatus to improve, for example, the display brightness uniformity of the display apparatus, the aperture ratio and resolution of the display apparatus, fabrication cost of the display apparatus, and other problems.

One aspect of the present disclosure provides a compensating circuit. The compensating circuit includes a feedback module and a driving transistor with a first gate, a second gate, a first electrode, and a second electrode. A first terminal of the feedback module is connected to a first voltage source and a second terminal of the feedback module is connected to the first electrode and the second gate of the driving transistor; and the first gate of the driving transistor is connected to a data line, and the second electrode of the driving transistor for outputting a driving current.

Optionally, the feedback module is configured to send signals reflecting a threshold voltage and a carrier mobility deviation of the driving transistor to the second gate of the driving transistor.

Optionally, the driving transistor is a double-gate transistor.

Optionally, the compensating circuit further includes a light-emitting device, wherein a first electrode of the light-emitting device is connected to the second electrode of the driving transistor, and the second electrode of the light-emitting device is connected to a second voltage source.

Optionally, the feedback module includes one or a combination of a resistor and a transistor.

Optionally, the feedback module is a single-gate transistor; and a gate and a first electrode of the feedback module is connected to the first voltage source, and a second electrode of the feedback module is connected to the first electrode and the second gate of the driving transistor.

Optionally, the feedback module is a single-gate transistor; and a gate of the feedback module is connected to a first control line, a first electrode of the feedback module is connected to the first voltage source, and a second electrode of the feedback module is connected to the first electrode and the second gate of the driving transistor.

Optionally, the feedback module is a double-gate transistor; and a first gate, a second gate, and a first electrode of the feedback module are connected to the first voltage source, and a second electrode of the feedback module is connected to the first electrode and the second gate of the driving transistor.

Optionally, the feedback module is a double-gate transistor; and a first gate and a second gate of the feedback module are connected to a first control line, a first electrode of the feedback module is connected to the first voltage source, and a second electrode of the feedback module is connected to the first electrode and the second gate of the driving transistor.

Optionally, the feedback module is a double-gate transistor; and a first gate and a first electrode of the feedback module are connected to the first voltage source, a second gate of the feedback module is floating, and a second electrode of the feedback module is connected to the first electrode and the second gate of the driving transistor.

Optionally, the feedback module is a double-gate transistor; and a first gate of the feedback module is connected to a first control line, a first electrode of the feedback module is connected to the first voltage source, the second gate of the feedback module is floating, and the second electrode of the feedback module is connected to the first electrode and the second gate of the driving transistor.

Optionally, the driving transistor and the feedback module both comprise one or a combination of an amorphous-silicon TFT, a low-temperature poly-silicon TFT, a metal-oxide TFT, and an organic-semiconductor TFT.

Optionally, the compensating circuit further includes a data write-in module to write data signals into the first gate of the driving transistor, wherein the data write-in module is a single-gate transistor; and a gate of the data write-in module is connected to a scan control line, a first electrode of the data write-in module is connected to a data line, and a second electrode of the data write-in module is connected to the first gate of the driving transistor.

Optionally, the compensating circuit further includes a data write-in module to write data signals into the first gate of the driving transistor, wherein the data write-in module is a double-gate transistor; and a first gate and a second gate of the data write-in module are connected to a scan control line, a first electrode of the data write-in module is connected to a data line, and a second electrode of the data write-in module is connected to the first gate of the driving transistor.

Optionally, the compensating circuit further includes a data write-in module to write data signals into the first gate of the driving transistor, wherein the data write-in module is a double-gate transistor; and a first gate of the write-in module is connected to a scan control line, a second gate of the data write-in module is floating, a first electrode of the data write-in module is connected to a data line, and a second electrode of the data write-in module is connected to the first gate of the driving transistor.

Optionally, the compensating circuit further includes a storage capacitor, wherein a first terminal of the storage capacitor is connected to the first gate of the driving transistor; and a second terminal of the storage capacitor is connected to one of the second voltage source, the first voltage source, and the first electrode of the light-emitting device.

Optionally, wherein the data write-in module comprises one of or a combination of an amorphous-silicon TFT, a low-temperature poly-silicon TFT, a metal-oxide TFT, and an organic-semiconductor TFT.

Another aspect of the present disclosure provides a display apparatus. The display apparatus incorporates the disclosed compensating circuits.

Another aspect of the present disclosure provides a method for driving a light emitting device using the disclosed compensating circuits. The method includes providing data signals to the first gate of the driving transistor to turn on the driving transistor; compensating for the threshold voltage and the carrier mobility deviation of the driving transistor based on information reflecting the threshold voltage and carrier mobility deviation of the driving transistor sent by the feedback module; and outputting a compensated driving current through the second electrode of the driving transistor to drive the light emitting device.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

For those skilled in the art to better understand the technical solution of the invention, reference will now be made in detail to exemplary embodiments of the invention, which are illustrated in the accompanying drawings. Wherever possible, the same reference numbers will be used throughout the drawings to refer to the same or like parts.

One aspect of the present disclosure provides a pixel circuit.

Figure 1:
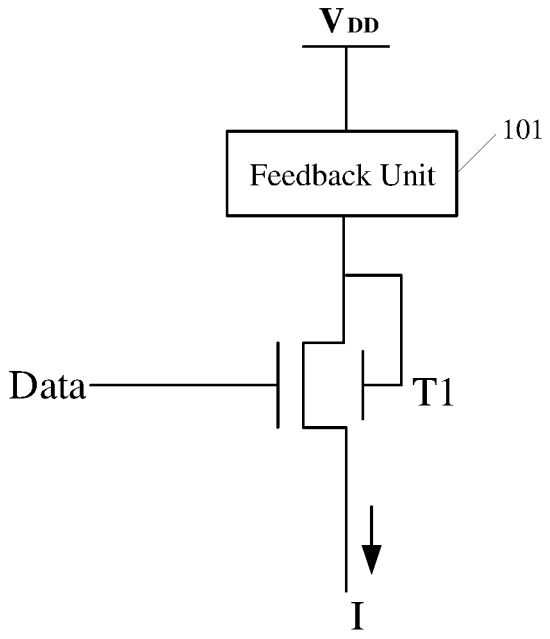
FIG. 1 illustrates an exemplary pixel circuit according to embodiments of the present disclosure.

The disclosed pixel circuit may be exemplified in embodiment 1, as shown in FIG. 1. The pixel circuit may include a feedback module 101 and a driving transistor T1. The feedback module 101 may be connected to a first voltage source $V_{DD}$. The feedback module 101 may send information reflecting the threshold voltage shift and carrier mobility deviation of the driving transistor T1 to the driving transistor T1 as feedback signals. The driving transistor T1 may be a double-gate transistor. A first gate of the driving transistor T1 may be used to receive data signal Data. A first electrode of the driving transistor T1 and a second gate of the driving transistor T1 may each be connected to the feedback module 101. A second electrode of the driving transistor T1 may be used to output driving current I. The direction of the current flow is indicated by the arrow (down).

The pixel circuit, using a double-gate transistor as the driving transistor T1, may adjust the operation status of the driving transistor T1 to compensate the threshold voltage shift caused by the aging of the driving transistor T1. Meanwhile, the pixel circuit may also compensate the carrier mobility deviation of the driving transistor T1. The pixel circuit may perform the adjustment and compensation actions described above based on information reflecting the threshold voltage of the driving transistor T1. The information reflecting the threshold voltage and the carrier mobility deviation of the driving transistor T1 may be contained in the feedback signals sent by the feedback module 101. Thus, the adjustment and compensation actions described above may improve the brightness non-uniformity of the corresponding light-emitting device (e.g., D illustrated in FIG. 2) caused by threshold voltage shift and/or carrier mobility deviation of the driving transistor T1. The display quality of the corresponding display panel may be improved.

Compared to many existing pixel circuits capable of compensating for the threshold voltage of the driving transistor (e.g., T1), the pixel circuit described above provides a simple circuit structure and supports a simple operation process while improving the aperture ratio and display resolution of the display panel. The fabricating yield of the display panel may thus be improved and the fabricating cost of the display panel may be reduced. Further, the disclosed pixel circuit may also compensate the threshold voltage shift of the driving transistor to provide driving current with improved uniformity to the light-emitting device.

Figure 2:
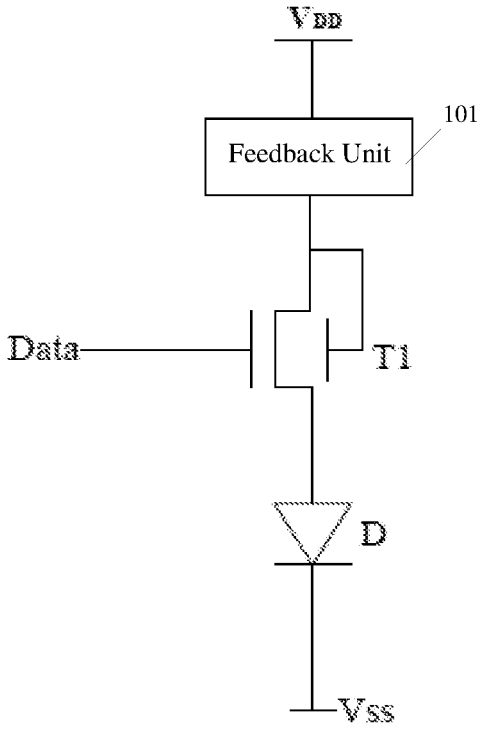
FIG. 2 illustrates an exemplary pixel circuit with a light-emitting device according to embodiments of the present disclosure.

In one embodiment, as shown in FIG. 2, the pixel circuit may also include a light-emitting device D. The second electrode of the driving transistor T1 may be connected to a first electrode of the light-emitting device D. The second electrode of the light-emitting device D may be connected to a second voltage source $V_{SS}$. The light-emitting device D may be an OLED.

It should be noted that, the light-emitting device D may also be an inorganic semiconductor light-emitting diode (LED) or other suitable light-emitting devices driven by electric currents. In addition, in one embodiment, the first electrode of the light-emitting device may be the anode, and the second electrode of the light-emitting device may be the cathode.

Figure 3:
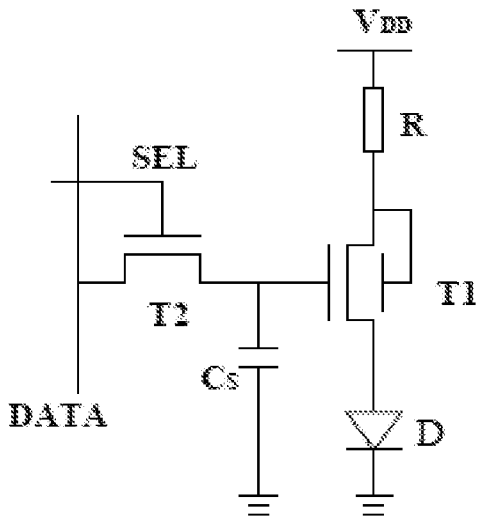
FIG. 3 illustrates the circuit diagram of an exemplary pixel circuit according to embodiments of the present disclosure.

As shown in FIG. 3, the feedback module may be a resistor R. A first terminal of the resistor R may be connected to the first voltage source $V_{DD}$, and a second terminal of the resistor R may be connected to the first electrode and the second gate of the driving transistor T1.

In one embodiment, the pixel circuit may also include a data write-in module to write data signals into the first gate of the driving transistor T1. The data write-in module may be a second transistor T2. The second transistor T2 may be a single-gate transistor (e.g., a single-gate TFT). The gate of the second transistor T2 may be connected to a scan control/enable line SEL. A first electrode (i.e., source) of the second transistor T2 may be connected to the data line DATA. A second electrode (i.e., drain) of the second transistor T2 may be connected to the first gate of the driving transistor T1.

In one embodiment, the pixel circuit may also include a storage capacitor $C_S$. A first electrode of the storage capacitor $C_S$ may be connected to the first gate of the driving transistor T1. A second terminal of the storage capacitor $C_S$ may be connected to the second voltage source $V_{SS}$. As shown in FIG. 3, the second voltage source $V_{SS}$ may be the ground.

In certain other embodiments, the second transistor T2 may also be a double-gate transistor (e.g., a double-gate TFT). In this case, the source of the second transistor T2 may be connected to the data line DATA, and the first gate and the second gate of the second transistor T2 may be both connected to the scan control line SEL. The drain of the second transistor T2 may be connected to the first terminal of the storage capacitor $C_S$ and the first gate of the driving transistor. The specific use of a double-gate transistor or a single-gate transistor as the second transistor T2 may be determined according to various applications and is not limited by the embodiments herein.

Another aspect of the present disclosure provides a method for driving the pixel circuits described above.

The method for driving the pixel circuits includes the following steps. The first gate of the driving transistor T1 may be used to receive the data signal DATA such that the driving transistor T1 can be turned on. The second electrode of the driving transistor T1 may be used to output the driving current I. Further, the feedback module may send information reflecting the threshold voltage and the carrier mobility deviation of the driving transistor T1 to the driving transistor T1, as feedback signals. The driving transistor T1 may compensate the threshold voltage and carrier mobility deviation based on the received feedback signals.

Figure 4:
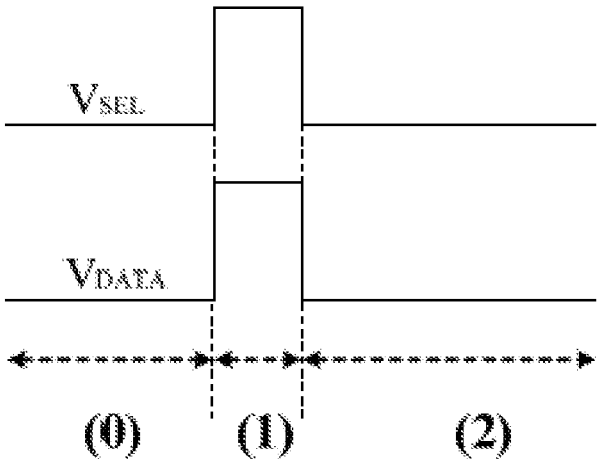
FIG. 4 illustrates an exemplary timing chart of the pixel circuit illustrated in FIG. 3.

Specifically, the operation of the disclosed pixel circuit may be exemplified in FIG. 4. As shown in FIG. 4, the operation process may include three phases. Each phase is indicated by the number listed below.

Phase (0) may represent the operation status of the pixel circuit in last frame. In phase (0), based on the gate voltage of the first gate of the driving transistor T1, the driving transistor T1 may provide an electric current (i.e., driving current) to the light-emitting device D such that the light-emitting device D may emit light.

Phase (1) may represent the operation status of the pixel circuit in a data-signal-write-in period. In phase (1), the scan control line SEL may input a high voltage $V_{SEL}$ on the second transistor T2, and the data voltage signal $V_{DATA}$, outputted by the data line DATA as a high voltage, may be written to the first gate of the driving transistor T1 through the second transistor T2. The storage capacitor $C_S$ may keep/maintain the data voltage signal $V_{DATA}$ on the first gate of the driving transistor T1 until the time of the next frame (i.e., phase 2), before the data voltage signal $V_{DATA}$ is updated.

Phase (2) may represent the operation status of the pixel circuit in a light-emitting-and-compensation period. In phase (2), the light-emitting device D may emit light and the feedback module may compensate the threshold voltage of the driving transistor T1. The scan control line SEL may input a low voltage $V_{SEL}$ to the second transistor T2 so that the second transistor T2 may be turned off. The high voltage maintained by the storage capacitor $C_S$ may keep the driving transistor T1 on so that the driving transistor T1 may drive the light-emitting device D to emit light. In the light-emitting period, the voltage on the first gate of the light-emitting device D, $V_{G1}$ may be equal to $V_{DATA}$, and $V_{G1}$ may remain the same such that the brightness of the light-emitting device D may remain the same until next frame, i.e., when the images displayed are updated. The electric current flowing through the light-emitting device D may be the driving current provided by the driving transistor T1. The driving current may be described in equation (1).

$$I_D = \frac{1}{2}\mu C_{OX}\frac{W}{L}(V_{GS} - V_{TH})^2 = \frac{1}{2}\mu C_{OX}\frac{W}{L}(V_{Data} - V_D - V_{TH})^2 \quad (1)$$

In equation (1), μ represents the carrier mobility of the driving transistor T1. $C_{OX}$ represents the gate capacitance per module area of the driving transistor T1. W represents the channel width of the driving transistor T1. L represents the channel length of the driving transistor T1. $V_{GS}$ represents the voltage difference between the first gate and the second electrode (source) of the driving transistor T1. $V_{TH}$ represents the threshold voltage of the driving transistor T1. $V_{DATA}$ represents the voltage value of the data voltage signal. $V_D$ represents the voltage on the first electrode of the light-emitting device.

The working principles (i.e., the compensating principles) of using the double-gate transistor as the driving transistor T1 to compensate the threshold voltage of the driving transistor T1 based on the feedback signals sent by the feedback module (resistor R1) can be described as follows. When the threshold voltage of the driving transistor T1 shifts as a result of long-time electrical stress, the threshold voltage of the driving transistor T1 may increase or decrease such that the driving current generated by the driving transistor T1 may change in an opposite trend, as shown in equation (1). For example, when the threshold voltage $V_{TH}$ increases, the driving current $I_D$ may decrease. When the threshold voltage $V_{TH}$ decreases, the driving current $I_D$ may increase. Since the voltage applied on the resistor R is $I_{DR}$, an increase of $V_{TH}$ may cause the voltage applied on the resistor R to decrease accordingly. A decrease of $V_{TH}$ may cause the voltage applied on the resistor R to increase accordingly. Since the voltages on the first electrode and the second gate of the driving transistor are both equal to $(V_{DD}-I_{DR})$, an increase of $I_D$ may cause the voltages on the first electrode and the second gate of the driving transistor T1 to decrease accordingly. A decrease of $I_D$ may cause the voltages on the first electrode and the second gate of the driving transistor to increase accordingly.

Further, when the two gates of the driving double-gate transistor are separately controlled, the threshold voltage of the double-gate transistor may vary according to either one of the gate voltages. That is, when the gate voltage of the second gate of the driving transistor T1 increases, the threshold voltage of the driving transistor T1 may decrease. The driving current may increase with signals of other electrodes of the driving transistor T1 being the same. When the gate voltage of the second gate of the driving transistor T1 decreases, the threshold voltage of the driving transistor T1 may increase, and the driving current may decrease with signals of other electrodes of the driving transistor T1 being the same. Thus, when the threshold voltage shift causes the threshold voltage of the driving transistor T1 to increase (i.e., the driving current flowing through the light-emitting device D decreases), the feedback signals provided by the resistor R may enable the threshold voltage of the driving transistor T1 to decrease and the generated driving current to increase (i.e., the driving current flowing through the light-emitting device D increases). Alternatively, when the threshold voltage shift causes the threshold voltage of the driving transistor T1 to decrease (i.e., the driving current flowing through the light-emitting device D increases), the feedback signals provided by the resistor R may enable the threshold voltage of the driving transistor T1 to increase and the generated driving current to decrease (i.e., the driving current flowing through the light-emitting device D decreases). Thus, the pixel circuits described above may suppress and improve non-uniformity of driving current caused by threshold voltage shifts of the driving transistor T1. The brightness level uniformity of the light-emitting device may be improved.

Besides the compensation of the threshold voltage shift of the driving transistor T1, the disclosed pixel circuit may also compensate the carrier mobility deviation of the driving transistor T1 by using the same compensating principles. For example, when the carrier mobility of the driving transistor T1 increases, the driving current generated by the driving transistor T1 may increase, and the voltage applied on the resistor R may increase. The potentials of the first electrode and the second gate of the driving transistor T1 may decrease, and the threshold voltage of the driving transistor T1 may increase. Thus, the driving current generated by the driving transistor T1 may decrease, and the carrier mobility deviation of the driving transistor T1 may be compensated. Variation of driving current flowing into the light-emitting device D, caused by the carrier mobility deviation of the driving transistor T1, may be suppressed. That is, the driving current provided by the driving transistor T1 may be stabilized. The disclosed pixel circuit may thus improve the non-uniformity of brightness of the light-emitting device D, and the display quality of the corresponding display panel can be improved.

Further, in a display panel, because the power line has resistance, the power signals (i.e., voltage signals) provided by a power line from a farther power supply (i.e., $V_{DD}$) may be different from the power signal provided by a power line from a closer power supply. Theoretically, since a driving transistor (e.g., a TFT) is often operated in the saturation region, the driving current provided by the driving transistor should be independent from the drain voltage, which is the actual power signal applied on the corresponding pixel. However, in practice, the driving current generated by a driving transistor may not be ideal, i.e., may not be saturated according to the drain voltage. That is, the driving current may be unsaturated and may vary as the drain voltage varies. The variation of the driving current may cause the pixels (e.g., OLEDs) connected to a power line (i.e., along a column direction) to emit light with varying, non-uniform brightness levels. Cross-talk between different pixels may occur. In the pixel circuits provided by the present disclosure, because a feedback module is provided, even considerable variations of the power signals may only cause the drain voltage of a driving transistor to undergo relatively small variations. Thus, the disclosed pixel circuits may greatly reduce differences in drain voltages of different driving transistors. The disclosed pixel circuits may greatly reduce unsaturated driving current and cross-talk between different driving transistors.

It should be noted that, in one embodiment, one or both of the driving transistor T1 and the second transistor T2 may be amorphous-silicon TFTs, low-temperature poly-silicon TFTs, metal-oxide TFTs, organic-semiconductor TFTs, or other suitable TFTs. The first electrode and the second electrode of the driving transistor T1 may be the source and drain of the driving transistor T1, or may be the drain and source of the driving transistor T1. The first electrode and the second electrode of the second transistor T2 may be the source and drain of the second transistor T2, or may be the drain and source of the second transistor T2.

Figure 5:
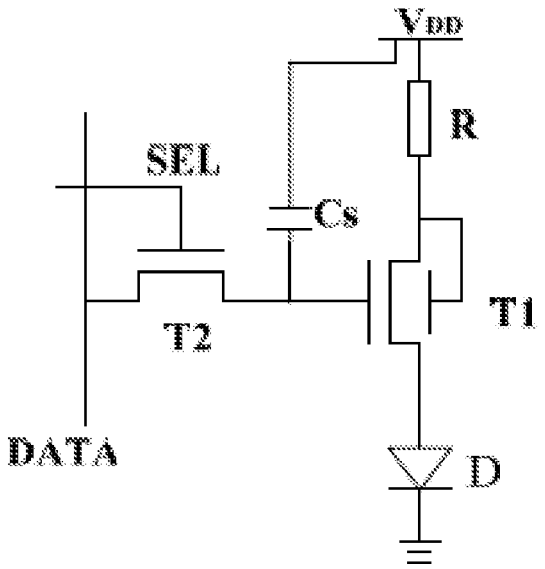
FIG. 5 illustrates another exemplary pixel circuit according to embodiments of the present disclosure.
Figure 6:
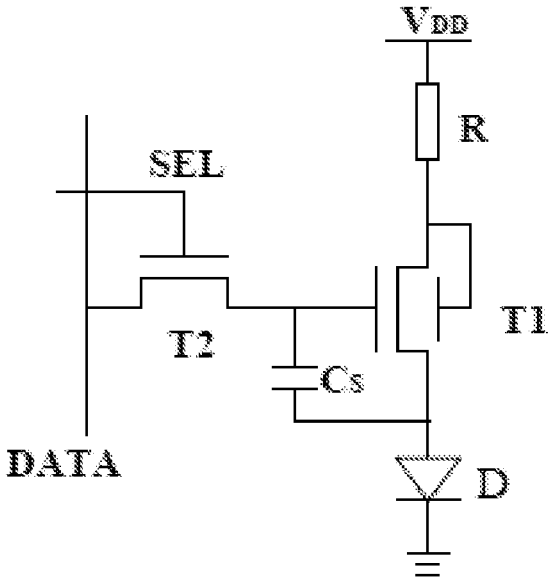
FIG. 6 illustrates another exemplary pixel circuit according to embodiments of the present disclosure.

In some embodiments, the second terminal of the storage capacitor $C_S$ may be connected to the first voltage source $V_{DD}$ (as shown in FIG. 5). In some embodiments, the second terminal of the storage capacitor $C_S$ may be connected to the first electrode of the light-emitting device D (as shown in FIG. 6).

Figure 7:
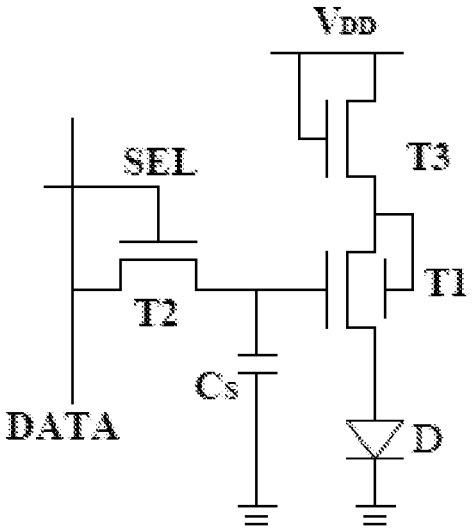
FIG. 7 illustrates another exemplary pixel circuit according to embodiments of the present disclosure.

Another pixel circuit provided by the present disclosure can be exemplified in embodiment 2. Different from embodiment 1, the pixel circuit, as illustrated in FIG. 7, may include a third transistor T3 as the feedback module. The third transistor T3 may be a single-gate transistor. The gate and the first electrode (i.e., the drain) of the third transistor T3 may be connected to the first voltage source $V_{DD}$. The second electrode (i.e., the source) of the third transistor T3 may be connected to the first electrode and the second gate of the driving transistor T1.

By using the third transistor T3 as the feedback module, the pixel circuit is also capable of sending feedback signals to the driving transistor T1 with information reflecting the threshold voltage and carrier mobility of the driving transistor T1. The driving transistor T1 may compensate the threshold voltage based on the feedback signals sent by the feedback module.

It should be noted that, The driving transistor T1 may be an amorphous-silicon TFT, a low-temperature poly-silicon TFT, a metal-oxide TFT, an organic-semiconductor TFT, or other suitable TFTs. The third transistor T3 may be an amorphous-silicon TFT, a low-temperature poly-silicon TFT, a metal-oxide TFT, an organic-semiconductor TFT, or other suitable TFTs. The first electrode of the third transistor T3 may be the source and the second electrode of the third transistor may be the drain of the third transistor T3. Alternatively, the first electrode of the third transistor T3 may be the drain and the second electrode of the third transistor T3 may be the source of the third transistor T3.

Figure 10:
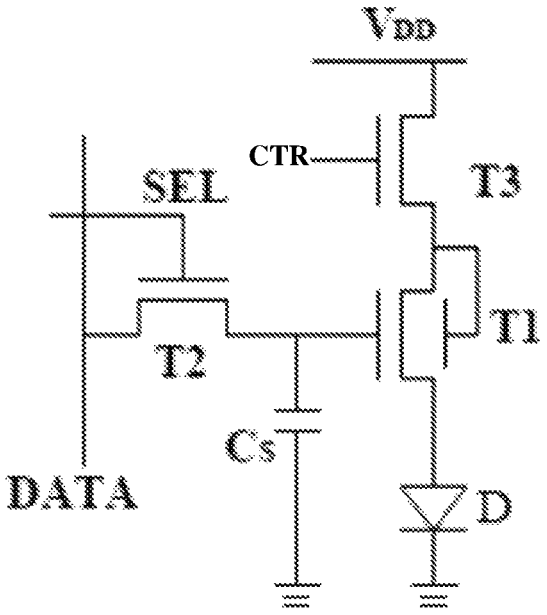
FIG. 10 illustrates another exemplary pixel circuit according to embodiments of the present disclosure

In certain other embodiments, the gate of the third transistor T3 may also be connected to a first control line, as shown in FIG. 10. CTR represents the first control line. Certain control signals may be applied on the gate of the third transistor T3 to control the ON and OFF states of the third transistor T3. The first electrode of the third transistor may also be connected to the first voltage source $V_{DD}$. The second electrode of the third transistor may also be connected to the first electrode and the second gate of the driving transistor.

The structure and other components of the pixel circuit, method for driving the pixel circuit, and principles to compensate the threshold voltage in embodiment 2 are the same as the pixel circuit described in embodiment 1, and are therefore omitted herein.

Figure 8:
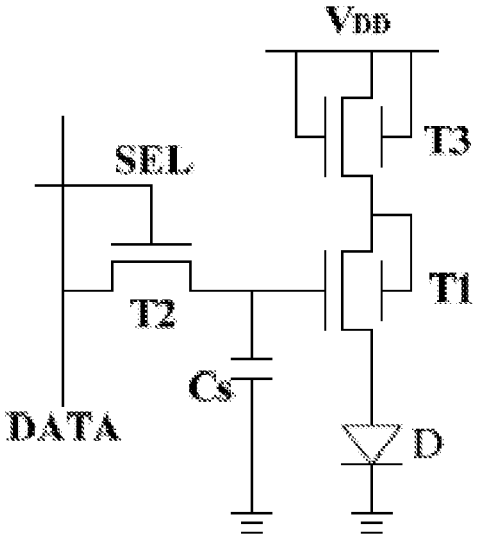
FIG. 8 illustrates another exemplary pixel circuit according to embodiments of the present disclosure.

Another pixel circuit provided by the present disclosure can be exemplified in embodiment 3. Different from embodiments 1 and 2, as shown in FIG. 8, the feedback module may be the third transistor T3, and the third transistor T3 maybe a double-gate transistor. The first gate, the second gate, and the first electrode of the third transistor T3 may be connected to the first voltage source $V_{DD}$. The second electrode of the third transistor T3 may be connected to the first electrode and the second gate of the driving transistor T1.

A double-gate transistor may have higher carrier mobility, lower sub-threshold slope, lower turn-on voltage, and more stable properties. Thus, by using a double-gate transistor as the third transistor T3, the pixel circuit may be operated with higher efficiency and higher stability. The driving transistor T1 may improve the compensation to the threshold voltage of the driving transistor T1.

It should be noted that, in certain other embodiments, the first gate and the second gate of the third transistor T3 may also be both connected to the first control line, and the first electrode of the third transistor may also be connected to the first voltage source $V_{DD}$. The second electrode of the third transistor T3 may also be connected to the first electrode and the second gate of the third transistor T3.

Structure and other components of the pixel circuit, method for driving the pixel circuit, and principles to compensate the threshold voltage in embodiment 3 are the same as the pixel circuit described in embodiment 1 or 2, and are omitted herein.

Figure 9:
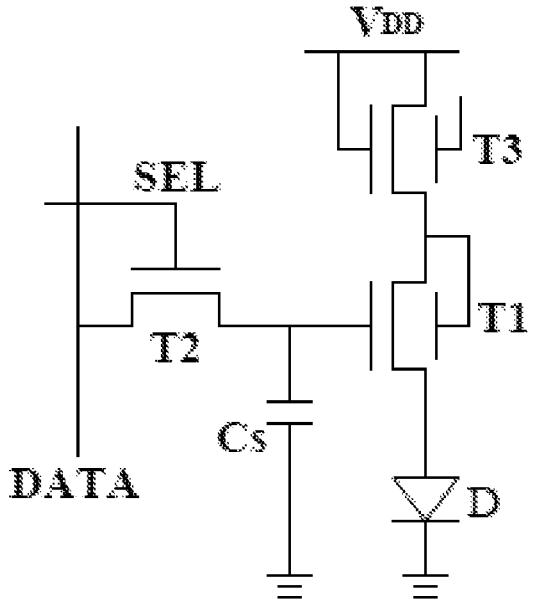
FIG. 9 illustrates another exemplary pixel circuit according to embodiments of the present disclosure.

Another pixel circuit provided by the present disclosure can be exemplified in embodiment 4. Different from embodiments 1 to 3, as shown in FIG. 9, the feedback module may be the third transistor T3, and the third transistor T3 may be a double-gate transistor. The first gate and the first electrode of the third transistor T3 may be connected to the first voltage source $V_{DD}$, and the second gate of the third transistor T3 may be floating. The second electrode of the third transistor T3 may be connected to the first electrode and the second gate of the driving transistor T1.

Compared to embodiment 3, the second gate of the third transistor T3 may be floating. Since the third transistor T3 is a double-gate transistor, the third transistor T3 in embodiment 4 may still enable the pixel circuit to be operated with high efficiency and high stability. The driving transistor T1 may thus improve the compensation to the threshold voltage of the driving transistor T1.

Figure 11:
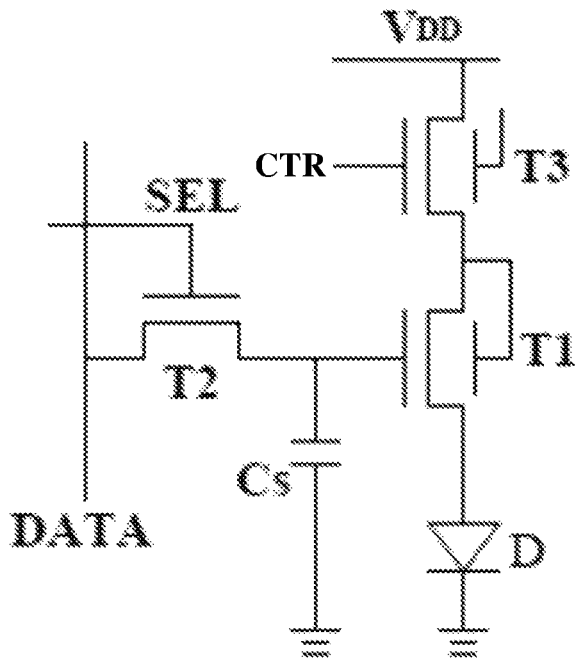
FIG. 11 illustrates another exemplary pixel circuit according to embodiments of the present disclosure.

It should be noted that, in certain other embodiments, the first gate of the third transistor T3 may also be connected to a first control line CTR, and the first electrode of the third transistor may be connected to the first voltage source $V_{DD}$, as shown in FIG. 11. The second gate of the third transistor T3 may be floating, and the second electrode of the third transistor T3 may be connected to the first electrode and the second gate of the driving transistor T1.

Figure 12:
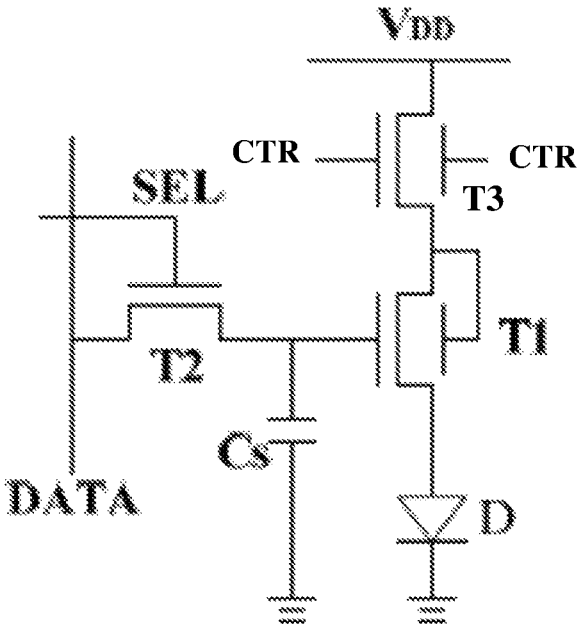
FIG. 12 illustrates another exemplary pixel circuit according to embodiments of the present disclosure.

In certain embodiments, the first gate and the second gate of the third transistor T3 may each be connected to a first control line CTR, as shown in FIG. 12. Certain control signals may be applied on the gates of the third transistor T3 to control the ON and OFF states of the third transistor T3

Structure and other components of the pixel circuit, method for driving the pixel circuit, and principles to compensate the threshold voltage in embodiment 4 are the same as the pixel circuit described in any one of embodiments 1 to 3, and are omitted herein.

Another pixel circuit provided by the present disclosure can be exemplified in embodiment 5. Different from embodiments 1 to 4, the pixel circuit may further include a data write-in module to write data signals into the first gate of the driving transistor. The data write-in module may be the second transistor, and the second transistor may be a double-gate transistor. The first gate and the second gate of the second transistor may be connected to scan control line SEL. The first electrode of the second transistor may be connected to the data line. The second electrode of the second transistor may be connected to the first gate of the driving transistor.

A double-gate transistor may have higher carrier mobility, lower sub-threshold slope, and better driving ability. Thus, by using a double-gate transistor as the second transistor, the pixel circuit may require less time to write data. The pixel circuit may be work well for display panels with larger sizes and higher display resolutions.

Structure and other components of the pixel circuit, method for driving the pixel circuit, and principles to compensate the threshold voltage in embodiment 5 are the same as the pixel circuit described in any one of embodiments 1 to 4, and are omitted herein.

Figure 13:
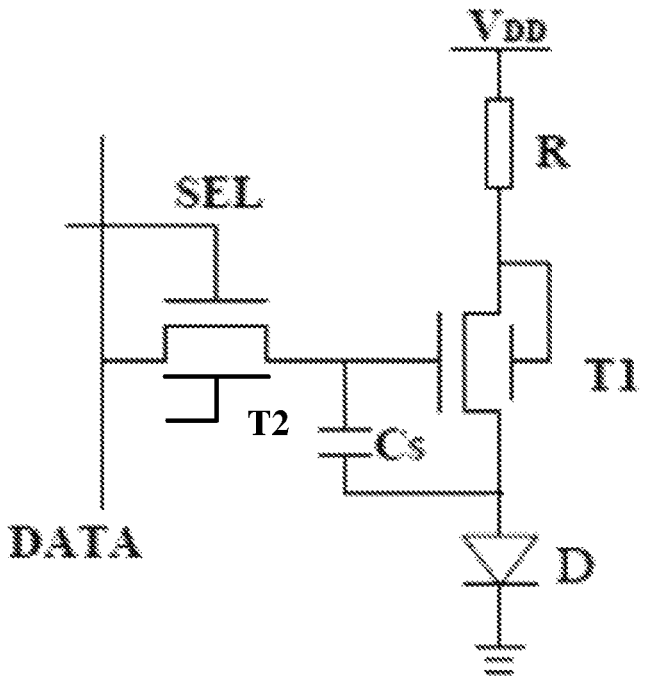
FIG. 13 illustrates another exemplary pixel circuit according to embodiments of the present disclosure.

Another pixel circuit provided by the present disclosure can be exemplified in embodiment 6. Different from embodiments 1 to 5, the pixel circuit may further include a data write-in module to write data signals into the first gate of the driving transistor. The data write-in module may be the second transistor, and the second transistor T2 may be a double-gate transistor. As shown in FIG. 13, the first gate of the second transistor may be connected to the scan control line SEL, and the second gate of the second transistor may be floating. The first electrode of the second transistor may be connected to the data line. The second electrode of the second transistor may be connected to the first gate of the driving transistor. The double-gate transistor T2 may be applied in various embodiments of the present disclosure.

Figure 14:
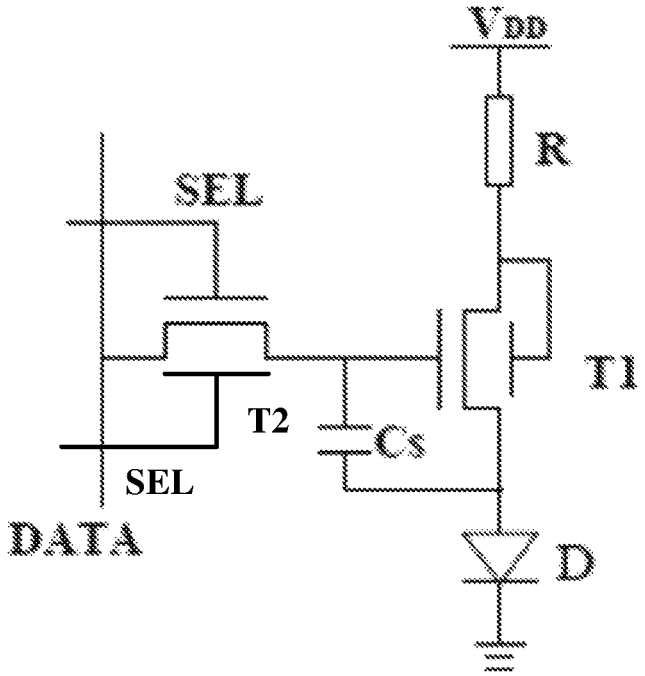
FIG. 14 illustrates another exemplary pixel circuit according to embodiments of the present disclosure.

In certain embodiments, as shown in FIG. 14, both gates of second transistor T2 may be connected to the scan control line SEL. The scan control line SEL may control the status of the second transistor T2 according to different applications/designs.

Structure and other components of the pixel circuit, method for driving the pixel circuit, and principles to compensate the threshold voltage in embodiment 6 are the same as the pixel circuits described in any one of embodiments 1 to 5, and are omitted herein.

The pixel circuits illustrated in embodiments 1 to 6 may have several advantages. By using a double-gate transistor as the driving transistor, based on the feedback signals sent by the feedback module, the pixel circuit may adjust the operating status of the pixel circuit to compensate for the threshold voltage shift caused by aging of the driving transistor and the carrier mobility deviation of the driving transistor. The feedback signals may contain information reflecting the threshold voltage and carrier mobility of the driving transistor. Thus, the pixel circuit may resolve brightness non-uniformity of the light-emitting device caused by the threshold voltage shift and carrier mobility deviation of the driving transistor. The display quality of the display panel may be improved. Compared to many of the existing pixel circuits capable of compensating for the threshold voltage of the driving transistor, the disclosed pixel circuits have simple structures. The operation of the disclosed pixel circuits may also be more straight forward. The display panels containing the disclosed pixel circuits may have improved aperture ratios and display resolutions. The fabricating yield of the display panels may also be improved. Fabricating cost may be reduced. Further, the disclosed pixel circuits may also compensate for carrier mobility deviations of the corresponding driving transistor and provide driving current with improved stability to the light-emitting device.

Another aspect of the present disclosure provides a display apparatus. The display apparatus includes any one of the pixel circuits illustrated in embodiments 1 to 6.

By using any one of the pixel circuits illustrated in embodiments 1 to 6 in the display apparatus, brightness non-uniformity of the display apparatus may be improved. The aperture ratio and the display resolution of the display apparatus may be improved, and the fabricating cost of the display apparatus may be reduced.

Exemplarily, the display device according to the embodiments of the present invention can be used in any product with display functions such as a display panel, a television, an LCD, an OLED, an electronic paper, a digital photo frame, a mobile phone and a tablet computer.

It should be understood that the above embodiments disclosed herein are exemplary only and not limiting the scope of this disclosure. Without departing from the spirit and scope of this invention, other modifications, equivalents, or improvements to the disclosed embodiments are obvious to those skilled in the art and are intended to be encompassed within the scope of the present disclosure.

What is claimed is:

1. A compensating circuit, comprising:

a feedback module; and a driving transistor with a first gate, a second gate, a first electrode, and a second electrode, wherein:

a first terminal of the feedback module is connected to a first voltage source and a second terminal of the feedback module is directly connected to the first electrode and the second gate of the driving transistor;

the first gate of the driving transistor is connected to a data line, and the second electrode of the driving transistor for outputting a driving current; and the first gate and the second gate of the driving transistor are controlled by two separate signals.

2. The compensating circuit according to claim 1, wherein the feedback module is configured to send signals reflecting a threshold voltage and a carrier mobility deviation of the driving transistor to the second gate of the driving transistor.

3. The compensating circuit according to claim 1, wherein the driving transistor is a double-gate transistor.

4. The compensating circuit according to claim 1, further including a light-emitting device, wherein a first electrode of the light-emitting device is connected to the second electrode of the driving transistor, and the second electrode of the light-emitting device is connected to a second voltage source.

5. The compensating circuit according to claim 1, wherein the feedback module comprises one or a combination of a resistor and a transistor.

6. The compensating circuit according to claim 5, wherein:

the feedback module is a single-gate transistor; and a gate and a first electrode of the feedback module is connected to the first voltage source, and a second electrode of the feedback module is connected to the first electrode and the second gate of the driving transistor.

7. The compensating circuit according to claim 6, wherein the driving transistor and the feedback module both comprise one or a combination of an amorphous-silicon TFT, a low-temperature poly-silicon TFT, a metal-oxide TFT, and an organic-semiconductor TFT.

8. The compensating circuit according to claim 5, wherein:

the feedback module is a single-gate transistor; and a gate of the feedback module is connected to a first control line, a first electrode of the feedback module is connected to the first voltage source, and a second electrode of the feedback module is connected to the first electrode and the second gate of the driving transistor.

9. The compensating circuit according to claim 5, wherein:

the feedback module is a double-gate transistor; and a first gate, a second gate, and a first electrode of the feedback module are directly connected to the first voltage source, and a second electrode of the feedback module is directly connected to the first electrode and the second gate of the driving transistor.

10. The compensating circuit according to claim 5, wherein:

the feedback module is a double-gate transistor; and a first gate and a second gate of the feedback module are connected to a first control line, a first electrode of the feedback module is connected to the first voltage source, and a second electrode of the feedback module is connected to the first electrode and the second gate of the driving transistor.

11. The compensating circuit according to claim 5, wherein:

the feedback module is a double-gate transistor; and a first gate and a first electrode of the feedback module are connected to the first voltage source, a second gate of the feedback module is floating, and a second electrode of the feedback module is connected to the first electrode and the second gate of the driving transistor.

12. The compensating circuit according to claim 5, wherein:

the feedback module is a double-gate transistor; and a first gate of the feedback module is connected to a first control line, a first electrode of the feedback module is connected to the first voltage source, the second gate of the feedback module is floating, and the second electrode of the feedback module is connected to the first electrode and the second gate of the driving transistor.

13. The compensating circuit according to claim 1, further including a data write-in module to write data signals into the first gate of the driving transistor, wherein:

the data write-in module is a single-gate transistor; and a gate of the data write-in module is connected to a scan control line, a first electrode of the data write-in module is connected to a data line, and a second electrode of the data write-in module is connected to the first gate of the driving transistor.

14. The compensating circuit according to claim 13, wherein the data write-in module comprises one of or a combination of an amorphous-silicon TFT, a low-temperature poly-silicon TFT, a metal-oxide TFT, and an organic-semiconductor TFT.

15. The compensating circuit according to claim 1, further including a data write-in module to write data signals into the first gate of the driving transistor, wherein:

the data write-in module is a double-gate transistor; and a first gate and a second gate of the data write-in module are connected to a scan control line, a first electrode of the data write-in module is connected to a data line, and a second electrode of the data write-in module is connected to the first gate of the driving transistor.

16. The compensating circuit according to claim 1, further including a data write-in module to write data signals into the first gate of the driving transistor, wherein:

the data write-in module is a double-gate transistor; and a first gate of the write-in module is connected to a scan control line, a second gate of the data write-in module is floating, a first electrode of the data write-in module is connected to a data line, and a second electrode of the data write-in module is connected to the first gate of the driving transistor.

17. The compensating pixel circuit according to claim 1, further including a storage capacitor, wherein:

a first terminal of the storage capacitor is connected to the first gate of the driving transistor; and a second terminal of the storage capacitor is connected to one of the second voltage source, the first voltage source, and the first electrode of the light-emitting device.

18. A display apparatus, including the compensating circuit according to claim 1.

19. A method for driving a light emitting device using the compensating circuit according to claim 1, including:

providing data signals to the first gate of the driving transistor to turn on the driving transistor;

compensating for the threshold voltage and the carrier mobility deviation of the driving transistor based on information reflecting the threshold voltage and carrier mobility deviation of the driving transistor sent by the feedback module; and outputting a compensated driving current through the second electrode of the driving transistor to drive the light emitting device.

20. A compensating circuit, comprising:

a feedback module; and a driving transistor with a first gate, a second gate, a first electrode, and a second electrode, wherein:

a first terminal of the feedback module is connected to a first voltage source and a second terminal of the feedback module is directly connected to the first electrode and the second gate of the driving transistor;

the first gate of the driving transistor is connected to a data line, and the second electrode of the driving transistor for outputting a driving current;

the feedback module is configured to send signals reflecting a threshold voltage and a carrier mobility deviation of the driving transistor to the second gate of the driving transistor; and the first gate and the second gate of the driving transistor are controlled by two separate signals.

* * * * *